US005288580A

United States Patent [19]

Julien et al.

[11] Patent Number: 5,288,580

[45] Date of Patent: * Feb. 22, 1994

[54] TONER AND PROCESSES THEREOF

[75] Inventors: Paul C. Julien, Webster; Robert J. Gruber; John L. Haack, both of Pittsford; Bing R. Hsieh, Webster, all of N.Y.

[73] Assignee: Xerox Corporation, Stamford, Conn.

[ * ] Notice: The portion of the term of this patent subsequent to Dec. 24, 2008 has been disclaimed.

[21] Appl. No.: 812,090

[22] Filed: Dec. 23, 1991

[51] Int. Cl.[5] ..... G03G 9/00

[52] U.S. Cl. ..... 430/110; 430/109; 430/106

[58] Field of Search ..... 470/106, 109, 110, 137

[56] References Cited

U.S. PATENT DOCUMENTS

| | | | |
|---|---|---|---|
| 3,983,045 | 9/1976 | Jugle et al. | 252/62.1 P |
| 4,023,606 | 11/1986 | Ciccarelli | 430/110 |
| 4,433,040 | 11/1986 | Niimura et al. | 430/109 |
| 4,624,907 | 11/1986 | Niimura et al. | 430/106 |
| 4,680,245 | 7/1987 | Suematsu et al. | 430/110 |
| 4,883,736 | 11/1989 | Hoffend et al. | 430/110 |
| 4,902,598 | 2/1990 | Winnik et al. | 430/110 |
| 4,935,326 | 6/1990 | Creatura et al. | 430/108 |
| 4,937,166 | 6/1990 | Creatura et al. | 430/108 |
| 4,985,328 | 1/1991 | Kumagai et al. | 430/110 |
| 5,075,185 | 12/1991 | Bertrand et al. | 430/122 |

FOREIGN PATENT DOCUMENTS

| | | | |
|---|---|---|---|
| 0180655 | 5/1986 | European Pat. Off. | 430/110 |
| 55-135854 | 10/1980 | Japan | 430/110 |

*Primary Examiner*—Marion E. McCamish
*Assistant Examiner*—Stephen C. Crossan
*Attorney, Agent, or Firm*—E. O. Palazzo

[57] ABSTRACT

A process for the preparation of toner compositions with excellent humidity characteristics and comprised of resin particles, and pigment particles which comprises adding thereto metal oxide particles surface treated with a metal salt complex charge enhancing additive.

9 Claims, No Drawings

TONER AND PROCESSES THEREOF

BACKGROUND OF THE INVENTION

The present invention is generally directed to toners, developers, and imaging processes, including a process for forming multicolor, including two-color, images, and more specifically, the present invention is directed to a process for controlling the relative humidity of colored toners by the addition thereto of colloidal silica particles surface treated or coated with a charge control additive. In one embodiment, the present invention comprises a process for effecting a reduction in the humidity sensitivity of colored, especially red, toners by adding to the toner a metal oxide, such as AEROSIL ® R972, which has been treated or coated with a metal salt complex charge additive, such as bis{4-[(3',5'-dinitro-2'-hydroxybenzene)azo]-3-hydroxy-2-naphthanilide} chromate (−1) hydrogen, commercially available as AIZEN SPILON BLACK TRH ®, from Hodogaya Chemical, reference U.S. Pat. No. 4,433,040, the disclosure of which is totally incorporated herein by reference. The resulting toners are particularly useful in color imaging and printing systems, such as trilevel xerography. In embodiments of the present invention, the toner obtained can be utilized at a range of relative humidities of, for example, from about 10 to about 90 percent without any substantial change in its electrical characteristics in two-color imaging processes, which in an embodiment comprises charging an imaging member, creating on the member a latent image comprising areas of high, medium, and low potential, developing the low areas of potential with a developer composition, subsequently developing the high areas of potential with a developer composition, transferring the developed image to a substrate, and optionally permanently affixing the image to the substrate, reference for example copending patent application U.S. Ser. No. 706,477 (D/91110), the disclosure of which is totally incorporated herein by reference. The toner in embodiments can be comprised on resin particles, a red negatively charged pigment, a positive charge enhancing additive, such as distearyl dimethyl ammonium methyl sulfate, and on the surface thereof a component comprised of an AEROSIL ® treated with a metal complex charge additive.

An advantage associated with the present invention is the ability to avoid the substantial loss of the charge level of color toners with a change in relative humidity through the use of charge control additives which when used in significant quantity lead to the deterioration of the color properties. An example of this type of charge control additive is bis{4-[(3',5'-dinitro-2'-hydroxybenzene)azo]-3-hydroxy-2-naphthanilide} chromate (-1) hydrogen (compound 1) commercially available as AIZEN SPILON BLACK TRH ® from Hodogaya Chemical, which is an effective negative charge control agent, particularly for stabilizing charge with a change in humidity, but which is also a black dye, rendering it substantially unsuitable for incorporation into the bulk of colored toners through melt blending. In the bulk, this compound is typically used at loading of 3 to 5 percent by weight, while with the present invention in embodiments this additive, and similar materials have significant effects in reducing the humidity sensitivity when used at loadings of 0.03 percent. This reduction of the amount of additive used by two orders of magnitude allows the use thereof without affecting the color properties of the toner.

The humidity sensitivity of a developer is an important factor in its performance. Developers generally lose some of their charge as humidity increases. If the charge level drops to a low level, for example below 0.2 fc/μ as measured in a toner charge spectrograph similar to that described in U.S. Pat. No. 4,375,673, the disclosure of which is totally incorporated herein by reference, the background level will be unacceptabe. Even if the value at high humidity is not unacceptably low, changes in charge level with humidity can be very undesirable. The density developed on the photoreceptor for a given photoreceptor voltage is determined by the charge level of the toner, and a change in charge level can produce an undesirable change in the density of the image on the paper. Changes in toner charging ability can be compensated for by controlling the image voltage or toner concentration through machine control algorithms, but with added complexity. Thus, decreases in charge level up to 80 percent when changing from cold/dry to hot/wet conditions can be controlled to some extent, and usable developers can be made when the drop in charge level between extremes is 50 to 60 percent or less. In the latter situation, the control algorithms may not be able to respond immediately, leading to a temporary deterioration in image quality. Improvements in humidity sensitivity with the processes of the present invention can provide more consistent developed mass densities, and therefore, excellent optical densities over a range of relative humidities from 10 to 90 percent.

In full color copiers the cyan, magenta, and yellow toners are usually blended in well controlled ratios to obtain the desired color. The relative amount of each toner deposited on the photoreceptor and thus blended to obtain a color is strongly affected by the charge level on the toner. A small change in the charge level of any one of the cyan, magenta, or yellow can cause an undesirable shift in the final blended color unless compensated for by adjusting other machine conditions. This adds more complexity to the control conditions, and renders it even more desirable to reduce developer humidity sensitivity. Color pigments are often quite humidity sensitive, while some of the most effective charge control agents for reducing humidity sensitivity are highly colored when used at typical effective concentrations.

The present invention allows the use of colored charge control agents at concentrations of from about 0.005 to about 0.1 percent, or low enough so that they do not adversely affect the color of a developer. In embodiments, a class of colored charge control additives can reduce the drop in charge level when moving between extremes in humidity from about 50 percent to about 25 percent, thus affecting a factor of two improvement in the stability and controllability of the developer.

In a patentability search report the following United States patents are recited: U.S. Pat. No. 4,902,598 which illustrates a process for the preparation of silica based charge additives by the reaction of a tetraalkoxysilane with an alcoholic alkaline solution in the presence of a soluble charge additive, see the Abstract for example; and as background interest U.S. Pat. Nos. 3,983,045; 4,624,907; 4,680,245 and 4,985,328, the disclosures of each of these patents being totally incorporated herein by reference.

Toner compositions with colored pigments are known. For example, there is disclosed in U.S. Pat. No. 4,948,686, the disclosure of which is totally incorporated herein by reference, process for the formation of two color images with a colored developer comprised of a first toner comprised of certain resin particles, such as styrene butadiene, a first pigment such as copper phthalocyanine, a charge control additive, colloidal silica and metal salts of fatty acid external surface additives, and a first carrier comprised of a steel core with, for example, a polymethyl methacrylate overcoating containing known conductive particles of, for example, carbon black such as BLACK PEARLS® carbon black, available from Columbian Chemicals, present in an effective amount of, for example, from about 1 to about 40 weight percent of the coating, and wherein the coating weight is, for example, from about 0.2 to about 4 weight percent; and a second developer comprised of a black toner, a second charge additive and a steel core carrier with certain polymeric overcoatings, see claim 1 for example. Examples of colored toner pigments are illustrated in column 9, lines 10 to 26, and examples of charge additives for the toner are detailed in column 9, lines 27 to 43, of the aforementioned patent. For the black toner, there can be selected the components as recited in columns 10 and 11, including charge additives such as distearyl dimethyl ammonium methyl sulfate, see column 11, lines 16 to 32. More specifically, there is illustrated in the U.S. Pat. No. 4,948,686 a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyestes, styrene-butadiene polymers, styrene-acrylate polymers, styrene-methacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; a second charge control additive present in an amount of from about 0.1 to about 6 percent by weight; a second carrier comprising a steel core with an average diameter of from about 25 to about 215 microns and a coating selected from the group consisting of a chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed two-color image to a substrate. Imaging members suitable for use with the process of the copending application may be of any type capable of maintaining three distinct levels of potential Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like. One disadvantage associated with the toners and imaging processes of the aforementioned patent include the use of a positive charged pigment, and a positive charge enhancing additive, resulting, it is believed, in images with lower resolutions than that obtained with the invention of the present application in embodiments.

Processes for obtaining electrophotographic, including xerographic, and two-colored images are known, reference for example the following U.S. Pat. No. 4,264,185, the disclosure of which is totally incorporated herein by reference, there is illustrated an apparatus for forming two color images by forming a bipolar electrostatic image of a two-color original document on a photoconductive drum; U.S. Pat. No. 4,308,821 discloses a method and apparatus for forming two-color images which employs two magnetic brushes; U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles; U.S. Pat. No. 4,430,402, discloses a two-component type dry developer for use in dichromatic electrophotography which comprises two kinds of developers, each of which is comprised of a toner and a carrier; U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner; U.S. Pat. No. 4,500,616 discloses a method of developing electrostatic latent images by selectively extracting colored grains of one polarity from a mixture thereof having opposite polarity to each other in the presence of an alternating field, followed by development of the electrostatic image by the selectively extracted colored grains; U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer; U.S. Pat. No. 4,525,447, the disclosure of which is totally incorporated herein by reference, illustrated an image forming method which comprises forming on a photosensitive member an electrostatic latent image having at least three different levels of potentials, or comprising first and second latent images and developing the first and second latent images with a three component developer; U.S. Pat. No. 4,539,281 discloses a method of forming dichromatic copy images by forming an electrostatic latent image having a first image portion and a second image portion, and wherein the first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier; U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable; an electrostatic latent image having at least three different levels of potential is formed and the toner and carrier are adhered, respectively, onto the first and second image portions; and U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential.

The process of charging a photoresponsive imaging member to a single polarity and creating on it an image of at least three different levels, trilevel, of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the trilevel process for generating images is U.S. Pat. No. 4,686,163, the disclosure of which is totally incorporated herein by reference. The aforementioned processes may be selected with the toners obtained with the process of the present invention.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may be comprised of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected.

Moreover, illustrated in copending application U.S. Ser. No. 500,335/91 (D/89404), the disclosure of which is totally incorporated herein by reference, are developers, toners and imaging processes thereof. In an embodiment of the copending application, there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned copending application the first developer comprises, for example, a first toner comprised of resin present in an effective amount of from, for example, about 70 to about 98 percent by weight, which resin can be selected from the group consisting of polyesters, styrene butadiene polymers, styrene acrylate polymers, styrene methacrylate polymers, PLIOLITES®, crosslinked styrene acrylates, crosslinked styrene methacrylates, and the like wherein the crosslinking component is, for example, divinyl benzene, and mixtures thereof; a first colored blue, especially PV FAST BLUE® pigment present in an effective amount of from, for example, about 1 to about 15 percent by weight, and preferably from about 5 to about 10 weight percent; an aluminum complex charge enhancing additive; and a second developer comprised of a second toner comprised of resin present in an effective amount of from, for example, about 70 to about 98 percent by weight, which resin can be selected from the group consisting of polyesters, styrene butadiene polymers, styrene acrylate polymers, styrene methacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene-n-butyl methylmethacrylate copolymer (58/42), 6 percent by weight of REGAL® 330 carbon black, and 2 percent by weight of the charge enhancing additive cetyl pyridinium chloride.

Illustrated in copending application U.S. Ser. No. 547,364 (D/90099), the disclosure of which is totally incorporated herein by reference, is a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin, a positively charging pigment, and a negatively charging pigment; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

Also illustrated are "Toner Processes with Metal Oxides" and "Processes for the Preparation of Composites and Toners Thereof" in copending applications U.S. Ser. No. 739,071 (D/91104) and U.S. Ser. No. 544,290 (D/90080), respectively, the disclosures of which are totally incorporated herein by reference. In U.S. Ser. No. 739,071, the use of metal oxides as toner additives avoids or minimizes scavengeless electrode contamination and in the U.S. Ser. No. 544,290 a process for preparing treated metal oxides, for example fine particle hydrophobic silicas, using a fluid bed is described.

SUMMARY OF THE INVENTION

It is a feature of the present invention to provide toner and developer compositions, and imaging processes thereof.

It is another feature of the present invention to provide imaging processes for obtaining multi-color, such as two-color, images, and discharge area development images, that is for example wherein the background areas of a charged layered imaging member can be developed.

In another feature of the present invention there are provided processes for obtaining toners wherein humidity does not adversely effect charge levels or minimizes the effects of undesirable toner tribo degradation.

Another feature of the present invention is to provide a process for forming two-color images wherein the first developer does not discharge the latent image to be developed by the second developer.

These and other features of the present invention can be accomplished by providing developers, toners and imaging processes thereof. In an embodiment of the present invention, there is provided a process for retaining the triboelectric characteristics of toners at relative humidities of from 20 percent to about 80 percent by adding to the toner, especially a color toner, a treated AEROSIL® component as illustrated herein. The toner selected can be comprised of resin, colored pigment, and charge additive.

A red toner which comprises admixing toner resin particles, colored pigment particles such as LITHOL SCARLET®, like LITHOL SCARLET D3700® available from BASF, and HOSTAPERM PINK®, especially HOSTAPERM PINK E® available from BASF, and thereafter blending therewith a positive or negative charge enhancing additive, followed by the addition of the treated silicas disclosed herein is selected in an embodiment of the present invention. Developers can be prepared by admixing the aforementioned toners with known carriers, such as steel, which is usually coated with a polymer, such as polymethylacrylate, and wherein the coating contains conductive particles, such as carbon black, like VULCAN® carbon black available from Cabot Corporation.

In an embodiment of the present invention, a red toner is prepared by blending together in a suitable known vessel, resin, a red pigment with a negative triboelectric charge, such as LITHOL SCARLET D3700® available from BASF, in a concentration from 5 to 15 percent and preferably from 5 to 10 percent, and a positively charging additive, such as distearyl dimethyl ammonium methyl sulfate in a concentration from 0.1 to 3 percent and preferably from about 0.5 to 2 percent, followed by the addition of zinc stearate in a concentration from 0.1 to 1 percent and preferably from 0.2 to 0.5 percent, and a surface additive comprised of colloidal silica, such as the known AEROSIL®, treated with a metal salt complex charge additive such as bis{4-[(3',5'-dinitro-2'-hydroxybenzene)azo]-3-hydroxy-2-naphthanilide}chromate (-1) hydrogen of the formula

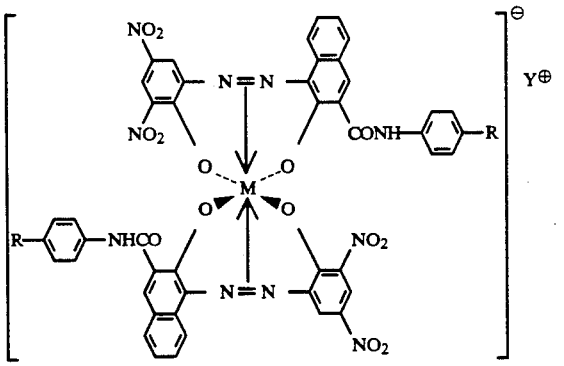

wherein M is a metal, R is hydrogen, alkyl, alkoxy, and the like, and Y is a cation, such as hydrogen, alkali metal like sodium, and the like as illustrated herein.

| Compound | M = | R = |
|---|---|---|
| 1 | $Cr^{3+}$ | —H |
| 2 | $Co^{3+}$ | —H |
| 3 | $Fe^{3+}$ | —H |
| 4 | $Cr^{3+}$ | $—(CH_2)_{11}—CH_3$ |
| 5 | $Cr^{3+}$ | $—SO_2NH—(CH_2)_7—CH_3$ |
| 6 | $Cr^{3+}$ | $—O(CH_2)_4—CH_3$ |

(compound 1) in an effective amount, such as a concentration from about 0.1 to 1 percent and preferably from about 0.2 to about 0.5 percent, to enable toners with excellent stable tribo properties for extended time periods at relative humidities of from about 20 to about 80 percent. Developers can be formulated by mixing the toner with known carrier particles, such as those comprised of a steel core with a 0.8 weight percent coating of polymethylacrylate containing conductive particles, for example about 20 weight percent of carbon black. The toner components can be blended in a Lodige Blender, attrited, micronized, and classified to provide toner particles with an average particle volume diameter of from about 9 to about 20, and preferably from about 10 to about 15 microns. For compounds 1 to 6, $Y^{\oplus}$ is hydrogen.

In another embodiment, a blue toner comprised of a negative aluminum charge control additive, such as an aluminum salt, as illustrated in the U.S. Pat. No. 4,845,003, the disclosure of which is totally incorporated herein by reference, like BONTRON E-88® available from Orient Chemicals of Japan is blended in a concentration from 0.1 to 5 percent and preferably from 0.5 to 4 percent with resin and a blue pigment, such as PV FAST BLUE®, in a concentration from 1 to 15 percent and preferably from 5 to 10 percent and subsequently blended with zinc stearate in a concentration from 0.1 to about 1 percent and preferably from 0.2 to 0.5 percent and a surface additive comprised of colloidal silica, such as the known AEROSIL® treated with a metal salt complex charge additive such as bis{4-[(3',5'-dinitro-2'-hydroxybenzene)axo]-3-hydroxy-2-naphthanilide} chromate (-1) hydrogen (compound 1) in a concentration of from about 0.1 to about 1 percent and preferably from about 0.2 to about 0.5 percent, to enable toners with excellent stable tribo properties for extended time periods at relative humidities of from about 20 to about 80 percent.

The developers of the present invention can be selected for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a color developer, especially red, obtained by the process of the present invention; (4) subsequently developing the high areas of potential by conductive magnetic brush development with a developer comprising a second developer comprised of carrier particles and a toner comprised of resin, black pigment, such as carbon black, and a charge, especially positive, enhancing additive; (5) transferring the developed two-color image to a suitable substrate; and (6) fixing the image thereto.

Examples of selected resin particles for the toners, especially the red and blue toners of the present invention include styrene acrylates, styrene methacrylates, polyesters, crosslinked styrene methacrylates, and styrene butadienes, especially those with a high, such as from about 80 to about 98 weight percent, styrene content like the commercially available Goodyear PLIOLITES®, PLIOTONES®, and the like. The resin is present in an effective amount of, for example, from about 70 to about 98 percent by weight, which resin can be a styrene butadiene with from about 89 to about 92 weight percent of styrene. Typical toner resins include styrene butyl methacrylates, linear polyesters, styrene-butadiene polymers, particularly styrene-butadiene copolymers wherein styrene is present in an amount of from about 83 to about 93 percent by weight, and preferably about 88 percent by weight, and butadiene is present in an amount of from about 7 to about 17 percent by weight, and preferably about 12 percent by weight, such as resins commercially available as PLIOLITE® or PLIOTONE® from Goodyear. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Furthermore, suitable are styrene-n-butylmethacrylate polymers wherein the styrene portion is present in an amount of from about 50 to about 80 percent by weight, and preferably about 65 percent by weight, and the n-butylmethacrylate portion is present in an amount of from about 50 to about 20 percent by weight, and preferably about 35 percent by weight.

Examples of red pigments include LITHOL SCARLET®, especially LITHOL SCARLET D3700®, LITHOL FAST SCARLET L4300®, LITHOL SCARLET K4165®, LITHOL RUBINE NB04573®, HOSTAPERM PINK E®, mixtures thereof, and the like, such as those pigments that are negatively charged. The aforementioned pigments are present in various effective amounts, such as for example from about 2 to about 15 weight percent, and preferably from about 5 to about 10 weight percent. Examples of blue pigments present in various effective amounts, such as illustrated herein with reference to the red pigments, and more specifically from about 2 to about 15 weight percent in preferred embodiments, include NEOPEN NB802®, SUDAN BLUE OS®, and the like. Also, mixtures of NEOPEN BLUE® and HOSTAPERM PINK®, mixtures of SUDAN BLUE OS ® and HOSTAPERM PINK ®, for example from about 8 to about 10 of the blue and from about 1 to about 2 of the pink, mixtures of NEOPEN BLUE ® and LITHOL RUBINE ®, for example from about 8 to about 10 of the blue and from about 1 to about 2 of the RUBINE ®, mixtures of SUDAN BLUE ® and LITHOL RUBINE ®, for example from about 8 to about 10 of the blue and from about 1 to about 2 of the Rubine, and the like, can be selected.

Charge enhancing additives which can be present in the toner in various effective amounts, such as from about 0.1 to about 20, and preferably from about 0.5 to about 5 weight percent include known additives such as distearyl dimethyl ammonium methyl sulfate, cetyl pyridinium halide, especially the chloride, bisulfides, and mixtures thereof. Examples of specific charge additives include alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, and the like. This toner can possess negative, or positive charge of from about 8 to about 45 microcoulombs per gram and preferably from about 10 to about 25 microcoulombs per gram, which charge is dependent on a number of known factors including the amount of charge enhancing additive present and the exact composition of the other compositions, such as the toner resin, the pigment, the carrier core, and the coating selected for the carrier core, and an admix time of from about 15 to about 60 seconds and preferably from about 15 to about 30 seconds. Examples of a negative charge additive include the aluminum complexes mentioned herein, such as BONTRON E-88 ® and E-84 ®, available from Orient Chemical Company of Japan, and other known negative charge enhancing additives.

In the preparation of the colored and toner compositions, the products obtained comprised of toner resin, pigment and charge enhancing additive can be subjected to micronization and classification, which classification is primarily for the purpose of removing undesirable fines, and screening to remove substantially very large particles to enable, for example, toner particles with an average volume diameter of from about 5 to about 25 microns and preferably from about 10 to about 20 microns. The aforementioned toners can include as surface or external components additives in an effective amount of, for example, from about 0.1 to about 3 weight percent of treated colloidal silicas, such as AEROSIL R972 ®, reference of example U.S. Pat. Nos. 3,590,000; 3,655,374; 3,900,588 and 3,983,045, the disclosures of which are totally incorporated herein by reference. Examples of specific external additives of colloidal silica, include AEROSIL R972 ®, AEROSIL R976 ®, AEROSIL R812 ®, and the like, available from Degussa. These additives can be treated or coated with the metal salt complexes illustrated herein by flash evaporation with a rotary evaporator of a suspension or solution of the additives in common organic solvents such as methanol, acetone, methylene chloride, tetrahydrofuran, toluene, and the like. Concentrations of the additives on the silicas range from 2 percent to 50 percent with the preferred range from 5 percent to 20 percent.

In the developer compositions examined, the humidity sensitivity of formulations incorporating the untreated AEROSIL ® was of the order of 50 percent while the change in charge level with formulations incorporating the treated or coated silicas was of the order of 25 percent. Charge levels were measured on the charge spectrograph discussed above. Relative humidity can be measured on several devices, such as a wet bulb/dry bulb thermometer.

The carrier for the colored developer in an embodiment of the present invention can be comprised of a steel core with an average diameter of from about 25 to about 225 microns, and a coating thereover, such as for example, selected from the group consisting of methyl terpolymer, polymethylmethacrylate, and a blend of from about 35 to about 65 percent by weight of polymethylmethacrylate and from about 35 to about 65 percent by weight of chlorotrifluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the black developer can be comprised of a steel core with an average diameter of from about 25 to about 225 microns and a coating thereover, such as for example, selected from the group consisting of chlorotrifluoroethylene-vinyl chloride copolymer containing from 0 to about 40 percent by weight of conductive particles and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. In embodiments, the carrier particles can be conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity can generally be controlled by the choice of carrier core and by partially coating the carrier core, or by coating the core with a coating containing carbon black, the carrier is rendered conductive. In addition, irregularly shaped carrier particle surfaces and toner concentrations of from about 0.2 to about 5 will generally render a developer conductive. Other known carriers may also be selected, including the carriers as illustrated in U.S. Pat. No. 4,883,736, the disclosure of which is totally incorporated herein by reference, and U.S. Pat. Nos. 4,937,166 and 4,935,326, the disclosures of which are totally incorporated herein by reference. The aforementioned carriers in one embodiment comprise a core with two polymer coatings not in close proximity in the triboelectric series.

More specifically, the carrier for the developers of the present invention generally can comprise a ferrite, iron or a steel core, preferably unoxidized, such as Hoeganoes Anchor Steel Grit, with an average diameter of from about 25 to about 215 microns, and preferably from about 50 to about 150 microns. These carrier cores can be coated with a solution coating of methyl terpolymer, reference for example U.S. Pat. Nos. 3,467,634 and 3,526,533, the disclosures of which are totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, with the coating weight being from about 0.2 to about 3 percent by weight of the carrier, and preferably from about 0.4 to about 1.5 percent by weight of the carrier. Also, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 0.8 percent by weight of the carrier. Another carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461 ® from Occidental Petroleum Company, and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Excellent solid area development, and excellent line copy development can be obtained when the aforementioned carriers are selected in embodiments of the present invention. Also, the developer of the present invention with passivated toner can possess in embodiments stable electrical characteristics for extended time periods of up to six months.

The triboelectric charge of the colored toners can vary depending on the developer components for example, generally, however, the tribo as determined by the known charge spectrograph is from about a negative 10 to about 30, and preferably from about a negative 15 to about 20 microcoulombs per gram; and the admix time of uncharged freshly added toner is from about 15 to about 60, and preferably about 30 seconds as determined by the known charge spectrograph or the Faraday Cage method.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may be comprised of either a positive or a negative potential, or both. In one embodiment, the image is comprised of three distinct levels of potential, all being of the same polarity. The levels of potential should be well differentiated, such that they are separated by at least 100 volts, and preferably 200 volts or more. For example, a latent image on an imaging member can be comprised of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a trilevel charge pattern may be formed by means of a raster output scanner, optically modulating laser light as it scans a uniformly charged photoconductive imaging member. In this embodiment, the areas of high potential are formed by turning the light source off; the areas of intermediate potential are formed by exposing the imaging member to the light source at partial power; and the areas of low potential are formed by exposing the imaging member to the light source at full power. Other electrophotographic and ionographic methods of generating latent images are also acceptable.

Generally, in the process of the present invention the highlighted areas of the image are developed with a developer comprised of a colored, especially red, toner as illustrated herein with a surface additive of a treated AEROSIL ®, while the remaining portions of the image are developed with the black developer illustrated herein, comprised, for example, of resin particles, black pigment particles, such as carbon black, like REGAL 330 ® carbon black, charge control additive, and carrier particles comprised, for example, of a steel core coated with a polymer, such as polymethyl methacrylate, and wherein the coating contains conductive particles, such as known conductive carbon blacks. In general, the highlighted color portions are developed first to minimize the interaction between the two developers, thereby maintaining the high quality of the black image.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

The black developers comprised, for example, of a positively charged toner with a pigment such as carbon black like REGAL 330®, which developers can be comprised of similar components as the aforementioned colored developers with the exceptions that a black instead of colored pigment is selected, and the charge enhancing additive is, for example, an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganoes Anchor Steel Grit, with an average diameter of from about 25 to about 215 microns, and preferably from about 50 to about 150 microns, with a coating of chlorotrifluoroethylene-vinyl chloride copolymer, commercially available as OXY 461 TM from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as TEDLAR® from E.I. Du Pont de Nemours and Company, present in a coating weight of from about 0.01 to about 0.2, and preferably about 0.05 percent by weight of the carrier. The polyvinyl fluoride coating is generally coated onto the core by a powder coating process wherein the carrier core is coated with the polyvinyl fluoride in powder form and subsequently heated to fuse the coating. In one preferred embodiment, the carrier comprises an unoxidized steel core which is blended with polyvinyl fluoride (TEDLAR®), wherein the polyvinyl fluoride is present in an amount of about 0.05 percent by weight of the core. This mixture is then heat treated in a kiln at about 400° F. to fuse the polyvinyl fluoride coating to the core. Optionally, an additional coating of polyvinylidene fluoride, commercially available as KYNAR® from Pennwalt Corporation, may be powder coated on top of the first coating of the carrier in the black developer at a coating weight of from about 0.01 to about 0.2 percent by weight.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer. The ratio of toner to carrier may vary, however. For example, an imaging apparatus employed for the process of the present invention may be replenished with a colored developer comprising about 55 percent by weight of toner and about 45 percent by weight of carrier. The triboelectric charge of the colored toners generally is from about −10 to about −30, and preferably from about −15 to about −20 microcoulombs per gram, although the value may be outside of this range. Particle size of the colored toners is generally from about 7 to about 20 microns in volume average diameter, and preferably about 13 microns in volume average diameter.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight, from about 1 to about 5 and preferably from about 1 to about 3 weight percent, is achieved.

The toners of the present invention may be prepared by processes such as extrusion, which is a continuous process that involves dry blending the resin, pigment, and charge control additive functioning as a passivating component, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns are preferred. The AEROSIL® treated surface additives are then blended, in effective amounts, such as from about 0.1 to about 1 weight percent with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

The disclosures of each of the U.S. Pat. Nos. and copending patent applications mentioned herein are totally incorporated herein by reference.

In embodiments, the present invention is directed to a process for the preparation of toner compositions comprised of resin particles, and pigment particles with excellent humidity characteristics which comprises the addition thereto of metal oxide particles surface treated with a metal salt complex charge enhancing additive, and a process for the preparation of toner compositions with substantially stable triboelectrical characteristics at relative humidities of from about 20 to about 80 percent, which process comprises the addition to a mixture of toner resin particles and pigment particles, metal oxide particles surface treated with metal salt complex charge enhancing additive. Examples of metal oxides include silicon dioxides, aluminum oxides, titanium oxides, iron oxides, tin oxides, chromium oxides, nickel oxides, strontium oxides, calcium oxides, cerium oxides, zirconium oxides, and the like.

The following examples are provided. All parts and percentages are by weight unless otherwise indicated.

COMPARATIVE EXAMPLE I

A red developer composition was prepared as follows. Ninety two (92) percent by weight of a styrene butadiene copolymer (89/11), 7 percent of the pigment LITHOL SCARLET D3700®, obtained from BASF, as a negative pigment to impart a negative charge to the toner, and 1 percent by weight of the positive charge control agent distearyl dimethyl ammonium methyl sulfate primarily for passivation of the pigment to a certain tribo, and for desirable admix characteristics, about 30 seconds, were melt blended in an extruder wherein the die was maintained at a temperature of between 130° and 145° C. and the barrel temperature ranged from about 80° to about 100° C., followed by micronization and air classification to yield toner particles of a size of 13 microns in volume average diameter. To the surface of the toner particles were then blended 0.3 percent by weight of AEROSIL® R972 and 0.3 percent by weight of zinc stearate by ball milling with steel beads for 30 minutes.

Subsequently, carrier particles were prepared by solution coating a Hoeganaes Anchor Steel core with a particle diameter of about 130 microns, available from Hoeganoes Company, with 0.8 part by weight of a coating comprising 20 parts by weight of VULCAN® carbon black, available from Cabot Corporation, homogeneously dispersed in 80 parts by weight of polymethyl methacrylate, which coating was solution coated from a toluene solvent. Sixty (60) grams of this carrier and 1.8 grams of the above prepared red toner were exposed in an environmental chamber set at 60° F., 20 percent relative humidity, for 15 hours. At the end of this time, the materials were poured into a two ounce bottle while in the chamber, sealed, removed from the chamber and roll milled for 15 minutes, resulting in a developer with a toner exhibiting a triboelectric charge of −1.15 femtocoulombs per micrometer (fc/μ) as determined in the charge spectrograph apparatus described in U.S. Pat. No. 4,375,673. One femtocoulomb is about $10^{-15}$ coulombs per gram.

The above toner and carrier in the same amounts was later exposed in an environmental chamber to 80° F., 80 percent relative humidity, for 15 hours. At the end of this time, the materials were poured into a two ounce bottle while in the chamber, sealed, removed from the chamber and roll milled for 15 minutes, resulting in a developer with a toner exhibiting a triboelectric charge of −0.55 fc/μ as determined in the charge spectrograph.

The ratio of high humidity charge (−1.15 fc/μ) level to low humidity charge (−0.55 fc/μ) level was 0.48. This low value is undesirable since it requires sustantive modifications in the xerographic machine operating conditions like exposure and development voltages, such as in the Xerox Corporation 5059 to produce the same image density. This in turn often leads to degraded performance characteristics such as high background in the low charge region if the machine is adjusted to produce adequate density in the high charge region. A ratio of 1 would indicate that no change is necessary in machine operating conditions through the different environmental condition parameters.

EXAMPLE I

A toner and developer were prepared by repeating the process of Comparative Example I with the exception that AEROSIL R972® treated with 10 percent of commerically available bis{4-[(3', 5'-dinitro-2'-hydroxybenzene)azol]-3-hydroxy-2-naphthanilide} chromate (−1) hydrogen (compound 1) (AIZEN SPILON BLACK TRH® from Hodogaya Chemical) was substituted for the untreated AEROSIL R972®. Using the method of Comparative Example I, the charge level after exposure to 60° F., 20 percent relative humidity, was now −0.95 fc/μ, and after exposure to 80° F., 80 percent relative humidity, was now −0.74 fc/μ. The ratio of the hot/wet to cold/dry charge levels was now 0.74. This relatively high value can accommodate substantial modifications in machine operating conditions so that the same image density is produced without affecting image quality, that is for example no background or dirt is observed, in the different environmental condition parameters.

EXAMPLE II

A toner and developer was prepared by repeating the process of Comparative Example I with the exception that the treated AEROSIL R972® contained 10 percent of bis{4-[(3',5'-dinitro-2'-hydroxybenzene)azo]-3-hydroxy-2-naphthanilide} chromate (−1) hydrogen (compound 1) identical to Example I except that it was synthesized as discussed by B. Hsieh in *Dyes and Pigments*, 1990, Vol. 14, No. 4, pages 287 to 305, the disclosure of which is incorporated in its entirety. Using the method of Comparative Example I, the charge level after exposure to 60° F., 20 percent relative humidity, was now −0.85 fc/μ, and after exposure to 80° F., 80 percent relative humidity, was now −0.60 fc/μ. The ratio of the hot/wet to cold/dry charge levels was 0.71.

EXAMPLE III

A toner and developer were prepared by repeating the process of Example I with the exception that the treated AEROSIL R972® contained 10 percent of a compound synthesized to have a composition identical to that of Example II except that the central chromium ion ($Cr^{3}+$) was replaced by a cobalt ion ($M=Co^{3}+$, compound 2) bis{4-[(3',5'-dinitro-2'-hydroxybenzene)azo]-3-hydroxy-2-naphthanilide} cobaltate (−1) hydrogen. This was done by substituting the appropriate cobalt salt for $Cr_2(SO_4)_3$ in the procedure referenced in Example II. Using the method of Comparative Example I, the charge level after exposure to 60° F., 20 percent relative humidity, was −0.85 fc/μ, and after exposure to 80° F., 80 percent relative humidity, was −0.65 fc/μ. The ratio of the hot/wet to cold/dry charge levels was 0.76.

EXAMPLE IV

A toner and developer were prepared by repeating the process of Example I with the exception that the treated AEROSIL R972® contained 10 percent of a compound synthesized to have a composition identical to that of Example II except that the central chromium ion ($Cr^{3}+$) was replaced by an iron ion ($M=Fe^{3}+$, compound 3) bis{4-[(3',5'-dinitro-2'-hydroxybenzene)azo]-3-hydroxy-2-naphthanilide} ferrate (-1) hydrogen. This was accomplished by substituting the appropriate iron salt for $Cr_2(SO_4)_3$ in the procedure referenced in Example II. Using the method of Comparative Example I, the charge level after exposure to 60° F., 20 percent relative humidity, was −0.85 fc/μ, and after exposure to 80° F., 80 percent relative humidity, was −0.60 fc/μ. The ratio of the hot/wet to cold/dry charge levels was 0.71.

EXAMPLE V

A toner and developer were prepared by repeating the process of Example I with the exception that the treated AEROSIL R972® contained 10 percent of bis{4-[(3',5'-dinitro-2'-hydroxybenzene)azo]4''-(n-dodecyl)-3-hydroxy-2-naphthanilide} chromate (−1) hydrogen (compound 4), a compound identical to that of Example II except that an alkyl side chain-$(CH_2)_{11}CH_3$ was attached to the two benzene rings as discussed in the reference of Example II. Using the method of Comparative Example I, the charge level after exposure to 60° F., 20 percent relative humidity, was −0.90 fc/μ, and after exposure to 80° F., 80 percent relative humidity, was −0.70 fc/μ. The ratio of the hot/wet to cold/dry charge levels was 0.78.

EXAMPLE VI

A toner and developer were prepared by repeating the process of Example I with the exception that the treated AEROSIL R972® contained 10 percent of bis{4-[(3',5'-dinitro-2'-hydroxybenzene)azo]-4''-(n-octysufamido)-3-hydroxy-2-naphthanilide} chromate (−1) hydrogen (compound 5), a compound identical to that of Example II except that an alkyl sulfonamide side chain $—SO_2NH(CH_2)_7CH_3$ was attached to the two benzene rings, reference Example II. Using the method of Comparative Example I, the charge level after exposure to 60° F., 20 percent relative humidity, was −0.90 fc/μ, and after exposure to 80° F., 80 percent relative humidity, was −0.70 fc/μ. The ratio of the hot/wet to cold/dry charge levels was 0.78.

EXAMPLE VII

A toner and developer were prepared by repeating the process of Example I with the exception that the treated AEROSIL® R972 contained 10 percent of bis{4-[(3',5'-dinitro-2'-hydroxybenzene)azo]-4''-(n-pentoxy)-3-hydroxy-2-naphthanilide} chromate (−1) hydrogen (compound 6), a compound identical to that of Example II except that an alkyl oxo side chain $—O(CH_2)_4CH_3$ was attached to the two benzene rings. Using the method of Comparative Example I, the charge level after exposure to 60° F., 20 percent relative humidity, was −0.90 fc/μ, and after exposure to 80° F., 80 percent relative humidity, was −0.65 fc/μ. The ratio of the hot/wet to cold/dry charge levels is 0.72.

As illustrated in the Examples, the synthesis and characterization of the aforementioned TRH compound and ring substituted derivatives, which compounds are available, have recently been described in *Dyes and Pigments,* 1990, Vol. 14, No. 4, pages 287 to 305, the disclosure of which is incorporated in its entirety. The metal ion substituted derivative compounds $2(M=Co^{3+})$ and $3(M=Fe^{3+})$ can be prepared by using an appropriate cobalt or iron salt in place of, for example, $Cr_2(SO_4)_3$ in the aforementioned literature procedure for preparing TRH. The counterion $Y+$ is also interchangeable and may be selected from the group comprised of H, alkali metals like Na, K, Li, $NH_4$, $NR_4$ where R is alkyl, and the like. The $NR_4$ counterions may be selected to further enhance the solubility and dispersibility of the metal azo complexes in organic solvents and further improve the humidity sensitivity of the complexes.

Other embodiments and modifications of the present invention may occur to those skilled in the art subsequent to a review of the present application; these embodiments and modifications, as well as equivalents thereof, are also included within the scope of this invention.

What is claimed is:

1. An imaging process consisting essentially of (1) charging an imaging member in an imaging apparatus; (2) creating on the member a latent image comprising areas of high, intermediate, and low potential; (3) developing the low areas of potential with a first developer comprising carrier and a substantially humidity insensitive toner comprised of resin particles and pigment particles having added thereto metal oxide particles surface treated with a metal salt complex charge enhancing additive selected from the group consisting of bis{4-[(3',5'-dinitro-2'-hydroxybenzene)azo]-3-hydroxy-2-naphthanilide} chromate (−1) hydrogen, bis{4-[(3',5'-dinitro-2'-hydroxybenzene)azo]-3-hydroxy-2-naphthanilide} cobaltate (−1) hydrogen, and bis{4-[(3',5'-dinitro-2'-hydroxybenzene)azo]-3-hydroxy-2-naphthanilide} ferrate (−1) hydrogen; (4) developing the high areas of potential with a second developer comprising carrier and a second toner comprised of resin, pigment, and a charge enhancing additive; (5) transferring the resulting developed image to a substrate; and (6) fixing the image thereto.

2. A process in accordance with claim 1 wherein the low and high areas of potential are developed by a conductive magnetic brush development system.

3. A process in accordance with claim 1 wherein said imaging member is comprised of a layered organic photoreceptor.

4. A process in accordance with claim 1 wherein said high level of potential is from about −750 to about −850 volts, said intermediate level of potential is from about −350 to about −450 volts, and said low level of potential is from about −100 to about −180 volts.

5. An imaging process in accordance with claim 1 wherein the metal oxide is selected from the group consisting of silicon dioxides, aluminum oxides, titanium oxides, iron oxides, tin oxides, chromium oxides, nickel oxides, strontium oxides, calcium oxides, cerium oxides, and zirconium oxides.

6. A process in accordance with claim 1, wherein said metal salt complex charge additive is selected from the group consisting of bis{4-3-hydroxy-2-naphthanilide} chromate (−1) hydrogen, bis{4-3-hydroxy-2-naphthanilide} cobaltate (−1)hydrogen, and bis {4-3-hydroxy-2-naphthanilide} ferrate (−1) hydrogen.

7. A process in accordance with claim 1 wherein the carrier is comprised of a metal core with an optional polymeric coating thereover.

8. A process in accordance with claim 1 wherein the carrier core is comprised of steel, ferrites, or iron.

9. A process in accordance with claim 8 wherein the ferrite is a copper nickel ferrite, copper zinc ferrite, copper zinc magnesium ferrite, or mixtures thereof.

* * * * *